United States Patent [19]

Cordova et al.

[11] Patent Number: 4,880,704

[45] Date of Patent: Nov. 14, 1989

[54] ORGANIC REINFORCING FIBERS WITH BUNDLE SEPARATION DURING FIBER CUTTING AND STORAGE

[75] Inventors: Colleen W. Cordova; David S. Cordova, both of Midlothian, Va.

[73] Assignee: Allied-Signal Inc., Morris Township, Morris County, N.J.

[21] Appl. No.: 174,044

[22] Filed: Mar. 28, 1988

[51] Int. Cl.[4] ..... D02G 3/00

[52] U.S. Cl. ..... 428/395; 428/288; 428/361; 428/375; 428/480

[58] Field of Search ..... 428/375, 378, 394, 395, 428/361, 480, 288; 57/258, 250, 257

[56] References Cited

U.S. PATENT DOCUMENTS 4,268,645 5/1981 Lark ..... 525/437

*Primary Examiner*—Lorraine T. Kendell

[57] ABSTRACT

The invention relates to a high tenacity reinforcing fiber having improved partitioning properties selected from the group consisting of polyester, aliphatic polyamide, and combinations thereof, for reinforcing plastic composites, said fiber being coated to enhance stiffness of the fiber for cutting with (a) 3 to 12 weight percent, based on weight of fiber of carboxyl-terminated, oil-free alkyd resin which is the reaction product of at least one aliphatic glycol containing 2 to 12 carbons with a combination of aromatic di- or trifunctional carboxylic acids and, optionally, an unsaturated aliphatic carboxylic acid, said resin having a degree of esterification below the gel point of the resin, and (b) 0.5 to 2 weight percent vinyl chloride copolymer having a glass transition termperature of greater than about 60° C.

14 Claims, No Drawings

ORGANIC REINFORCING FIBERS WITH BUNDLE SEPARATION DURING FIBER CUTTING AND STORAGE

BACKGROUND OF THE INVENTION

1. Field of the Invention

The present invention relates to a high tenacity, high elongation, low shrinkage synthetic fiber treated to enhance stiffness and interfilament coherency, and to improve partitioning properties. The resulting fiber, combined in multiple high denier bundles, can be cut at high speed to suitable reinforcing lengths for use in reinforcing a resin matrix. The cut fiber can be used in bulk molding compounds (BMC), sheet molding compounds (SMC) and spray-up applications due to ease of cutting.

2. Description of Related Art

Synthetic fibers in staple or filamentary form, and fabrics produced therefrom, are known for polymer reinforcement. Typical of the fibrous reinforcements are glass, polyester, polyamide (nylon and aramid) and polyolefin fibers. Conventional matrix resins include thermoplastics, such as nylon and polyolefins, and thermosetting materials, such as epoxy and unsaturated polyester resins. Since the primary function of the interface between fiber and matrix is to transmit stress from the matrix to the reinforcing fibers, the chemical and physical features of the interface are critical to the mechanical properties and end use performance of the composite. The compatibility between the reinforcing fiber and matrix is then a determining factor in the load sharing ability of the composite.

Fiber coatings/binders have been used to enhance the compatability of the reinforcing fibers and resins with which they are to be used.

Fiber bundle integrity is the degree to which individual filaments adhere to each other. A benefit of a low integrity fiber is that it enables good dispersion of single filaments throughout a resin matrix. This even distribution results in a homogeneous reinforced composite, a direct result of which is an improved cosmetic appearance. U.S. Pat. No. 4,632,864 to Cordova et al., issued Dec. 30, 1986, discloses a composite reinforced with a high tenacity reinforcing fiber with low bundle integrity, the fiber having been treated with a composition comprising a vinyl chloride copolymer having a glass transition temperature of greater than about 60° C. to enhance compatibility of the fiber and the resin matrix.

However, in operations where high speed cutting, on the order of from 100 to 500 feet per minute (about 30 to 150 meters per minute) or higher, of the fiber is required, e.g., SMC's and spray-up, a low integrity fiber tends to fluff or cottonball and jam up the cutter. In such applications a high integrity yarn that is readily cut at high speed, that does not ball-up within the reinforced composite, and that provides individual bundle separation is desirable.

U.S. patent application Ser. No. 136,080 filed Dec. 21, 1987, discloses a composite reinforced with a high tenacity reinforcing fiber with high bundle integrity, the fiber having been treated with a composition comprising an aqueous solution of carboxyl-terminated, oil-free alkyd resin which is the reaction product of at least one aliphatic glycol containing 2 to 12 carbons with a combination of aromatic di- or trifunctional carboxylic acids and, optionally, unsaturated aliphatic acids. These alkyd resins are polymerized below their gel points, that is the degree of esterification is generally maintained below about 90 percent. Bundle integrity is increased while retaining compatibility of the reinforcing fiber with the resin.

In addition to advantages in high speed cutting, a fiber with high bundle integrity offers advantages in those applications in which it is preferred that the bundle of filaments remain coherent in the resin matrix rather than to disperse into single filaments. A finish such as that discussed above in U.S. patent application Ser. No. 136,080 serves to increase bundle integrity which is preserved when the cut fiber is mixed with resin matrix. However, the finish required for bundle integrity can create storage problems for the reinforcing fiber. If several ends of multifilament yarn are combined into tow, then rolled into a package, pressure during storage may be sufficient to cause the several ends to adhere together, creating problems in the separation of these ends into individual bundles. If a tow is produced (a number of fiber bundles drawn together for ease of cutting in SMC and BMC), the tow must separate into distinct fiber bundles (ends) such that clumps of yarn do not occur. This is necessary for homogeneous properties of the reinforced composite and improved cosmetic appearance. For instance, filaments from a first end may adhere too tightly to a second end and peel away from the first end when the second end is separated. Such "ribboning" is undesirable. Another example of "ribboning" would occur during unwinding, when individual filaments from beneath may adhere to the layer being unwound, causing entanglements which can result in breaking of the fiber. Also, if the multifilament yarn is first cut to reinforcing lengths, then packed and stored, the pressure during storage may cause the individual cut bundles to "clump" together, creating problems when the cut fiber is mixed into the resin matrix.

Thus, the need exists for synthetic fiber for reinforcing plastic composites, said fiber having high bundle integrity to permit high speed cutting and unwinding and to permit inclusion of a coherent bundle of filaments into the resin matrix, yet providing sufficient properties that the individual bundles of filaments do not adhere to each other.

SUMMARY OF THE INVENTION

The invention relates to a high tenacity reinforcing fiber having improved partitioning properties selected from the group consisting of polyester, aliphatic polyamide, and combinations thereof, for reinforcing plastic composites, said fiber being coated to enhance stiffness of the fiber for cutting with (a) 3 to 12 weight percent, based on weight of fiber of carboxyl-terminated, oil-free alkyd resin which is the reaction product of at least one aliphatic glycol containing 2 to 12 carbons with a combination of aromatic di- or trifunctional carboxylic acids and, optionally, an unsaturated aliphatic carboxylic acid, said resin having a degree of esterification below the gel point of the resin, and (b) 0.5 to 2 weight percent vinyl chloride copolymer having a glass transition temperature of greater than about 60° C.

The resulting fiber provides high bundle integrity when incorporated into a resin matrix, can be cut into short fiber length at high speeds, and displays excellent partitioning properties.

DETAILED DESCRIPTION OF THE INVENTION

The present invention provides a high tenacity reinforcing fiber with high integrity and selected from the group consisting of polyester, polyamide, aramid and olefin for reinforcing plastic composites. The fiber may be staple or continuous filament. The reinforcing fiber is coated with a first overfinish composition comprising an aqueous solution of carboxyl-terminated, oil-free alkyd resin which is the reaction product of at least one aliphatic glycol containing 2 to 12 carbons with a combination of aromatic di- or trifunctional carboxylic acids, and optionally, an unsaturated aliphatic acid. These alkyd resins are polymerized below their gel points, that is the degree of esterification is generally maintained below about 90 percent. The reinforcing fiber is heated to dry the first coating, then coated with a second overfinish composition comprising a vinyl chloride copolymer, preferably an aqueous dispersion thereof, having a glass transition temperature ($T_g$), determined by differential thermal analysis, of at least 60° C., preferably 60° to 70° C. Alternatively, the alkyd resin and vinyl chloride copolymer may be combined into a single overfinish composition which can be applied to the fiber, then heated to dry. The fiber produced has a high bundle integrity and is readily cut for SMC and spray-up applications. The cut fiber filaments readily disperse in the resin matrix.

A sufficient amount of the overfinish components are applied to achieve a solids pickup of 3 to 12 weight percent, most preferably 3 to 6 weight percent of the alkyd resin and 0.5 to 2 weight percent of the vinyl chloride copolymer, amounts given based on weight of the fiber.

For production of the alkyd resin suitable aliphatic glycols include ethylene glycol, diethylene glycol, triethylene glycol, propylene glycol, tetraethylene glycol, butane diol, butene diol, butyne diol, and combinations thereof. Suitable aromatic carboxylic acids include orthophthalic acid, orthophthalic anhydride, isophthalic acid, terephthalic acid, trimellitic acid, trimellitic anhydride, 2,6-naphthalene dicarboxylic acid, phenylindane dicarboxylic acid, trimesic acid, 4,4'-diphenyl-dicarboxylic acid, 2,6-pyridene dicarboxylic acid, p-hydroxylmethyl benzoic acid, 5-tert-butyl isophthalic acid, bimesitylene-4,4'-dicarboxylic acid, and combinations thereof.

When the combination of carboxylic acids also includes an unsaturated aliphatic acid/acids, it is preferably selected from the group consisting of maleic acid, maleic anhydride, fumaric acid and combinations thereof.

Preferred alkyd resin solutions are as follows, the most preferred being listed first:

(a) a salt, preferably ammonium and sodium in a 50/50 ratio, solution of the condensation polymer consisting essentially of:

diethylene glycol, preferably about 45 to 55 moles, and most preferably about 49.8 moles;

isophthalic acid, preferably about 15 to 25 moles, and most preferably about 21.3 moles;

terephthalic acid, preferably about 15 to 25 moles, and most preferably about 21.4 moles; and trimellitic anhydride, preferably about 5 to 10 moles, and most preferably about 7.5 moles.

(b) a salt, preferably ammonium, solution of the condensation polymer consisting essentially of:

diethylene glycol, preferably about 35 to 40 moles, most preferably about 37.4 moles;

propylene glycol, preferably about 10 to 20 moles, most preferably about 14.6 moles;

maleic anhydride, preferably about 2.5 to 5 moles, most preferably about 3.8 moles;

isophthalic acid, preferably about 15 to 20 moles, most preferably about 17.9 moles;

terephthalic acid, preferably about 15 to 20 moles, most preferably about 16.1 moles; and trimellitic anhydride, preferably about 5 to 15 moles, most preferably about 10.2 moles.

(c) a solution of the condensation polymer consisting essentially of:

diethylene glycol, preferably about 5 to 10 moles, most preferably about 7 moles;

isophthalic acid, preferably about 5 to 10 moles, most preferably about 6 moles; and trimellitic anhydride, preferably about 0 to 3 moles, most preferably about 1.05 moles.

(d) a solution of the condensation polymer consisting essentially of:

propylene glycol, preferably about 3 to 8 moles, most preferably about 4 moles;

isophthalic acid, preferably about 0 to 3 moles, most preferably about 1 mole;

trimellitic anhydride, preferably about 0 to 3 moles, most preferably about 1 mole; and maleic anhydride, preferably about 0 to 3 moles, most preferably about 1 mole.

An example of a suitable vinyl chloride copolymer emulsion for use as the second overfinish 1 component is GEON® 351 vinyl chloride latex available from B. F. Goodrich, and characterized by glass transition temperature ($T_g$)+62° C., synthetic anionic emulsifier, approximate total solids 55 percent, specific gravity of latex 1.16 to 1.18, pH 10.5, surface tension 39 dynes/cm and Brookfield viscosity 20 cP with spindle #1, 50 rpm at 25° C., produced by emulsion polymerization with acrylate monomer.

The synthetic multifilament yarns suitable for reinforcing plastic composites are preferably high tenacity, high elongation, low shrinkage yarns selected from the group consisting of polyester, aliphatic polyamide, aramid, and polyolefin.

Examples of reinforcing polyester fiber include the linear terephthalate polyesters, i.e., polyesters of a glycol containing from 2 to 20 carbon atoms and a dicarboxylic acid component containing at least about 75 percent terephthalic acid. The remainder, if any, of the dicarboxylic acid component may be any suitable dicarboxylic acid such as sebacic acid, adipic acid, isophthalic acid, sulfonyl-4,4'-dibenzoic acid, 2,8-dibenzofuran-dicarboxylic acid, or 2,6-naphthalene dicarboxylic acid. The glycols may contain more than two carbon atoms in the chain, e.g., diethylene glycol, butylene glycol, decamethylene glycol, and bis-(1,4-hydroxylmethyl)cyclohexane. Examples of linear terephthalate polyesters which may be employed include polyethylene terephthalate, polyethylene terephthalate/5-chloroisophthalate (85/15), polyethylene terephthalate/5-sodium sulfoisophthalate (97/3), polycyclohexane-1,4-dimethylene terephthalate, and polycyclohexane-1,4-dimethylene terephthalate/hexahydroterephthalate (75/25). Examples also include liquid crystal forming highly aromatic polyesters as taught in U.S. Pat. Nos. 3,975,487; 4,083,829; and 4,285,852 and in W. J. Jackson and H. F. Kuhfuss, J. Poly. Sci. 14, 2043 (1976).

Suitable reinforcing polyamides include, for example, those prepared by condensation of hexamethylene diamine and adipic acid, condensation of hexamethylene diamine and sebacic acid, condensation of butylene diamine and adipic acid known as nylon 6,6, nylon 6,10, and nylon 4,6, respectively, condensation of bis(para-aminocyclohexyl)methane and dodacanedioic acid, or by polymerization of 6-caprolactam, 7-aminoheptanoic acid, 8-caprylactam, 9-aminopelargonic acid, 11-aminoundecanoic acid, and 12-dodecalactam, known as nylon 6, nylon 7, nylon 8, nylon 9, nylon 11, and nylon 12, respectively.

A preferred polyester reinforcing fiber is polyethylene terephthalate, characterized by a thermal shrinkage of up to about 11 percent, preferably 3 percent or less; a modulus after cure of at least about 60, preferably 70 to 90 grams per denier; and a tenacity of at least 5.5, preferably at least 7 grams per denier. By modulus after cure is meant the modulus of the fiber after exposure in an unconstrained state to curing temperatures for the composite.

A preferred polyamide reinforcing fiber is a high tenacity aliphatic polyamide fiber characterized by a drawn denier of 2 to 8 denier per filament, a thermal shrinkage of up to about 14 percent, an elongation of less than 28 percent, and a tenacity of at least 5.5, preferably at least 7 grams per denier.

The synthetic multifilament yarn of this invention is treated with a finish composition to increase fiber bundle integrity and to increase stiffness. This is essential to the invention to provide a yarn that is readily cut at high speed and which does not ball-up within the reinforced composite. A high integrity yarn, cut to a desired reinforcing length, can be added to the resin matrix and the individual filament bundles within the cut yarn will retain some degree of coherency within the resin matrix.

An example of a suitable overfinish composition with the alkyd resin component is disclosed in U.S. patent application Ser. No. 136,080 filed Dec. 21, 1984, discussed above and incorporated herein by reference.

The alkyd resin finish composition is preferably applied as an overfinish to drawn yarn. The finish is applied in known ways in an amount sufficient to yield enhanced stiffness and fiber bundle integrity, preferably 3 to 12 weight percent solids pickup, more preferably from 3 to 6 weight percent based on weight of yarn. After the overfinish composition is applied, the yarn is dried, for example by passing through a forced hot air heat chamber.

After drying and prior to packaging the finished yarn, it is essential to apply to the surface of the coated yarn a sufficient amount of the vinyl chloride copolymer emulsion at 0.5 to 2 weight percent solids pickup.

Multiple strands, or ends, of yarn so treated can then be combined to create a desired package. For example 11 ends of 1000 denier 192 filament yarn that has been coated with the alkyd resin and vinyl chloride copolymer can be combined to form 11 individual 192 filament bundles, then packaged for shipment. This 11000 denier package can be unwound and fed to high speed cutting apparatus with no sticking and ribboning problems, which cuts the fiber to desired reinforcing length. As a result of this invention, even after exposure to pressure and temperature encountered during storage, the 11000 denier package can be cut to desired lengths that break into 1000 denier/192 filament fiber bundles rather than into individual filaments. Also, when yarn so treated is cut into suitable reinforcing lengths, and these cut lengths are packaged, even after periods of storage with exposure to heat and pressure the cut lengths readily separate into the fiber bundles, and problems from the cut fiber bundles clumping together are avoided.

EXAMPLE 1

Eleven strands of 1000 denier, high tenacity, high elongation, low shrinkage polyester yarn, commercially available from Allied-Signal Inc. as 1W72 were removed from a supply package and passed over a kiss roll applicator for application of a finish composition to achieve 5 percent pickup. The finish composition was an aqueous dispersion with 20 percent total solids of a 50/50 ammonium/sodium salt solution of the condensation polymer consisting of 49.8 moles of diethylene glycol in conjunction with 21.3 moles of isophthalic acid, 21.4 moles of terephthalic acid and 7.5 moles of trimellitic anhydride. The yarn was then passed through a 20-kilowatt macrowave oven (Radio Frequency Company) for about 0.1 to 0.2 second to dry to a stiff consistency.

The yarn was then dipped into a second finish bath of vinylchloride copolymer (an aqueous dispersion of vinylchloride copolymer GEON® 351 vinylchloride latex available from B. F. Goodrich) and immediately was taken up on a winder (not dried). The yarn was then checked for ribboning and cutting separation. See Table 1 for results. Nonribboning performance is measured by separation of the 11,000 denier bundle into 1,000 denier strands (which was the feeder yarn to make the 11,000 denier bundle) when unwound from the package and chopped. Finish on yarn is presented as weight percent solids based on weight of the yarn.

TABLE 1

| Finish on Yarn, % | | |
|---|---|---|
| Alkyd Resin | Vinyl Chloride Copolymer | Nonribboning Performance |
| 5 | 1.0 | Satisfactory |
| 5.2 | 1.5 | Satisfactory |
| 4.0 | 0.9 | Satisfactory |
| 3.8 | 1.2 | Satisfactory |

EXAMPLE 2

Eleven strands of 1000 denier, high tenacity, high elongation, low shrinkage polyester yarn, commercially available from Allied-Signal Inc. as 1W72 were removed from a supply package and passed over a kiss roll applicator for application of a finish composition to achieve 5 percent pickup. The finish composition consisted of a mixture of a vinylchloride copolymer (GEON® 351 vinylchloride latex available from B. F. Goodrich) at various compositions with a 50/50 ammonium/sodium salt solution of the condensation polymer consisting of 49.8 moles of diethylene glycol in conjunction with 21.3 moles of isophthalic acid, 21.4 moles of terephthalic acid and 7.5 moles of trimellitic anhydride. The yarn was then passed through a 20-kilowatt macrowave oven (Radio Frequency Company) for about 0.1 to 0.2 second, the eleven strands brought together as a single bundle and taken up on a winder.

The yarn was then removed from the package as well as cut into ½ inch (1.3 cm) reinforcing lengths and shaken onto a table. Ribboning performance was observed. See Table 2.

TABLE 2

| Ratio of Solids Alkyd Resin/Vinylchloride | Finish on Yarn, % Total Solids | Nonribboning Performance |
|---|---|---|
| 1:1 | 6 | No strand integrity |
| 2:1 | 5 | Satisfactory |
| 3:1 | 5 | Satisfactory |
| 4:1 | 4.5 | Some ribboning |

EXAMPLE 3

Each of the samples from Examples 1 and 2 were compounded with unsaturated polyester resin, molded into plaques, and the resulting composites tested for tensile strength, flexural strength, notched impact strength, and unnotched impact strength. No decline in properties resulted from the presence of any of the vinylchloride copolymer either as a mixture (Example 2) or double dip (Example 1).

What is claimed:

1. A high tenacity reinforcing fiber having improved partitioning properties selected from the group consisting of polyester, aliphatic polyamide, and combinations thereof, for reinforcing plastic composites, said fiber being coated to enhance stiffness of the fiber for cutting with (a) 3 to 12 weight percent, based on weight of fiber of carboxyl-terminated, oil-free alkyd resin which is the reaction product of at least one aliphatic glycol containing 2 to 12 carbons with a combination of aromatic di- or trifunctional carboxylic acids and, optionally, an unsaturated aliphatic carboxylic acid, said resin having a degree of esterification below the gel point of the resin., and (b) 0.5 to 2 weight percent vinyl chloride copolymer having a glass transition temperature of greater than about 60° C.

2. The fiber of claim 1 wherein the aliphatic glycol is selected from the group consisting of ethylene glycol, diethylene glycol, triethylene glycol, propylene glycol, tetraethylene glycol, butane diol, butene diol, butyne diol, and combinations thereof.

3. The fiber of claim 2 wherein the aromatic carboxylic acid is selected from the group consisting of orthophthalic acid, orthophthalic anhydride, isophthalic acid, terephthalic acid, trimellitic acid, trimellitic anhydride, 2,6-naphthalene dicarboxylic acid, phenylindane dicarboxylic acid, trimesic acid, 4,4'-diphenyldicarboxylic acid, 2,6-pyridine dicarboxylic acid, p-hydroxymethyl benzoic acid, 5-tert-butyl isophthalic acid, bimesitylene-4-4'-dicarboxylic acid, and combinations thereof.

4. The fiber of claim 3 wherein said combination of carboxylic acids comprises said unsaturated aliphatic acid selected from the group consisting of maleic acid, maleic anhydride, fumaric acid, and combinations thereof.

5. The fiber of claim 1 wherein the aliphatic glycol is diethylene glycol and wherein the aromatic carboxylic acids are isophthalic acid, terephthalic acid and trimellitic anhydride.

6. The fiber of claim 5 with 3 to 6 weight percent alkyd resin, wherein the alkyd resin is the condensation polymer consisting essentially of about 45 to 55 moles of diethylene glycol in conjunction with about 15 to 25 moles of isophthalic acid, about 15 to 25 moles of terephthalic acid and about 5 to 10 moles of trimellitic anhydride.

7. The fiber of claim 1 wherein the aliphatic glycols are diethylene glycol and propylene glycol, and wherein the aromatic carboxylic acids are isophthalic acid, terephthalic acid, and trimellitic anhydride, and wherein said combination of carboxylic acids additionally comprises maleic anhydride.

8. The fiber of claim 7 with 3 to 6 weight percent alkyd resin, wherein the alkyd resin is the condensation polymer consisting essentially of about 35 to 40 moles of diethylene glycol, about 10 to 20 moles of propylene glycol, about 2.5 to 5 moles of maleic anhydride, about 15 to 20 moles of isophthalic acid, about 15 to 20 moles of terephthalic acid and about 5 to 15 moles of trimellitic anhydride.

9. The fiber of claim 1 wherein the aliphatic glycol is diethylene glycol and the aromatic carboxylic acids are isophthalic acid and trimellitic anhydride.

10. The fiber of claim 9 with 3 to 6 weight percent alkyd resin, wherein the alkyd resin is the condensation polymer consisting essentially of about 5 to 10 moles of diethylene glycol, about 5 to 10 moles isophthalic acid, and about 0 to 3 moles trimellitic anhydride.

11. The fiber of claim 1 wherein the aliphatic glycol is propylene glycol, and wherein the aromatic carboxylic acids are isophthalic acid and trimellitic anhydride, and wherein said combination of carboxylic acids further comprises maleic anhydride.

12. The fiber of claim 11 with 3 to 6 weight percent alkyd resin, wherein the alkyd resin is the condensation polymer consisting essentially of about 3 to 8 moles of propylene glycol, about 0 to 3 moles of isophthalic acid, about 0 to 3 moles of trimellitic anhydride and about 0 to 3 moles of maleic anhydride.

13. The fiber of claim 5 wherein the fiber is polyester characterized by a thermal shrinkage of up to about 11 percent, an elongation of from about 10 to 28 percent, and a modulus after cure of at least about 60 grams per denier.

14. The fiber of claim 13 wherein the polyester fiber is characterized by a tenacity of about 7 to 9 grams per denier, a thermal shrinkage of at most about 3 percent, an elongation of about 14 to 24 percent and a modulus after cure of about 70 to 90 grams per denier.

* * * * *